US008007662B2

(12) United States Patent
Lomas et al.

(10) Patent No.: US 8,007,662 B2
(45) Date of Patent: Aug. 30, 2011

(54) DIRECT FEED/EFFLUENT HEAT EXCHANGE IN FLUID CATALYTIC CRACKING

(75) Inventors: David A. Lomas, Barrington, IL (US); Peter J. Van Opdorp, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 375 days.

(21) Appl. No.: 12/413,022

(22) Filed: Mar. 27, 2009

(65) Prior Publication Data

US 2010/0243527 A1 Sep. 30, 2010

(51) Int. Cl.
*C10G 11/00* (2006.01)
*B01J 38/12* (2006.01)

(52) U.S. Cl. ..... 208/108; 208/208 R; 208/209; 208/254 R

(58) Field of Classification Search ..... 208/108, 208/208 R, 209, 254 R
See application file for complete search history.

(56) References Cited

U.S. PATENT DOCUMENTS

| | | | | |
|---|---|---|---|---|
| 4,003,822 A | | 1/1977 | Jo | 208/102 |
| 4,097,362 A | | 6/1978 | McKinney et al. | 208/78 |
| 4,137,152 A | | 1/1979 | Chester et al. | 208/120 |
| 4,432,863 A | * | 2/1984 | Myers et al. | 208/113 |
| 4,934,366 A | | 6/1990 | Truex et al. | 128/419 |
| 5,098,554 A | | 3/1992 | Krishna et al. | 208/113 |
| 5,846,402 A | | 12/1998 | Mandal et al. | 208/113 |
| 5,944,982 A | | 8/1999 | Lomas | 208/164 |
| 6,287,522 B1 | | 9/2001 | Lomas | 422/144 |
| 7,029,571 B1 | | 4/2006 | Bhattacharyya et al. | 208/76 |
| 2006/0191820 A1 | | 8/2006 | Mo et al. | 208/120.1 |
| 2007/0090020 A1 | | 4/2007 | Buchanan et al. | 208/106 |
| 2008/0156696 A1 | | 7/2008 | Niccum et al. | 208/78 |

OTHER PUBLICATIONS

Aitani, A. et al., "Maximum of FCC light olefins by high severity operation and ZSM-5 addition," *Catalysis Today* (60) 2000, pp. 111-117.

Fujiyama, Y. et al., "Development of high-severity FCC process: an overview," *ACS National Meeting Book of Abstracts* 232 2006, 232nd *American Chemical Society Meeting and Exposition,* 2006, San Francisco, CA American Chemical Society, p. 1. [Abstract Only].

Maadhah, M.A. et al., "High severity FCC: a novel process for the production of light olefins and high-octane gasoline,"; *Proceedings of the Sixteenth World Petroleum Congress,* 2000, Calgary, Alberta, pp. 205-207.

Yatsuzuka, et al., "Development of HS-FCC (high-severity FCC) process," *2000 International 5, Petroleum Energy Center,* 2000. pp. 1-5.

Maadhah, A. et al., "A novel high-severity FCC process for enhancing the production of light olefins," *World Petroleum Congress Proceedings 3 2002, Proceedings of the 17th World Petroleum Congress,* 2002, Rio de Janeiro. p. 565 [Abstract Only].

(Continued)

*Primary Examiner* — Timothy Vanoy
(74) *Attorney, Agent, or Firm* — James C. Paschall

(57) ABSTRACT

Fluid catalytic cracking (FCC) processes are described, in which hydroprocessed hydrocarbon streams or other hydrocarbon feed streams having a low coking tendency are subjected to direct heat exchange with the FCC reactor effluent, for example in the FCC main column. The processes operate with sufficient severity such that little or no net FCC main column bottoms liquid (e.g., with a 343° C. (650° F.) distillation cut point) is generated. Regeneration temperatures with the representative low coking tendency feeds are beneficially increased by using an oxygen-enriched regeneration gas stream.

20 Claims, 1 Drawing Sheet

OTHER PUBLICATIONS

Abul-Hamayel, M.A., "Enhancing the production of light olefins and high-octane gasoline in a novel FCC process," *ACS Division of Petroleum Chemistry, Inc.* Preprints 46(4) 2001, ACS 222nd National Meeting, 2001, Chicago, IL, pp. 371-373.

Fujiyama, Y. et al., "Technology: high-severity FCC: a new process to maximize refinery propylene," *Hydrocarbon Asia* 16(3) 2006 AP Energy Business Publications Pte. Ltd., pp. 20-25.

Maghrabi, A. et al., "High severity fluid catalytic cracking demonstration plant design,"*King Fand University of Petroleum and Minerals Research Institute Annual Catalysts in Petroleum Refining and Petrochemicals* Symposium Papers 2001, 11th Annual Saudi-Japanese Symposium on Catalysts in Petroleum Refining and Petrochemicals, 2001, Dhahran, 10 p.

Johnson, A. et al., "Upgrade residues with FCCU's designed for high severity operation," *Fuel Reformulation* (ISSN 1062-3744) v 4 n 6, (Nov.-Dec. 1994), pp. 61-66.

Abul-Hamayel, M.A., "Atmospheric residue as feedstock to high-severity fluid catalytic cracking," *Petroleum Science and Technology 20(5/6)* 2002 pp. 497-506.

* cited by examiner

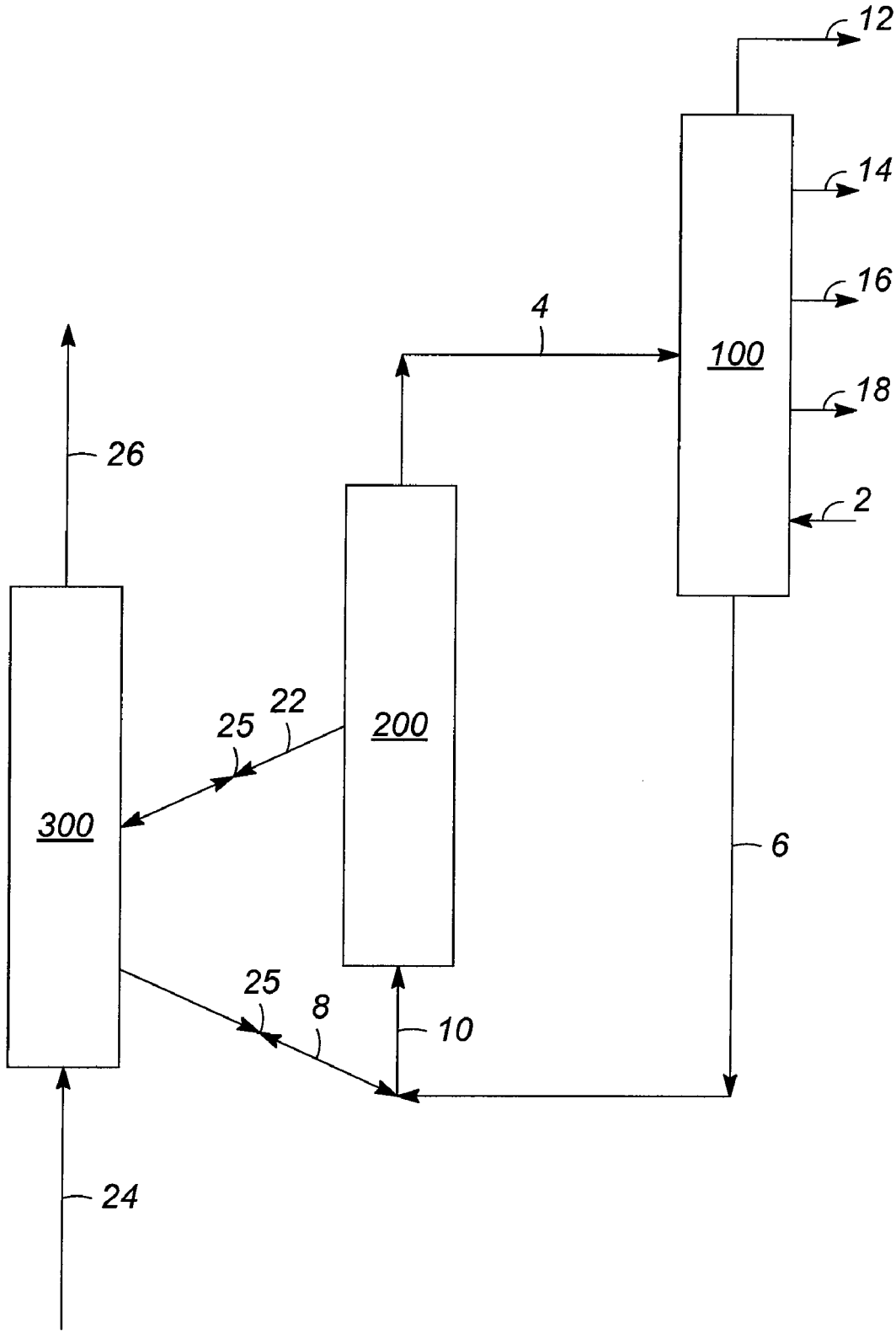
12
14
16
18
2
4
100
26
200
22
25
300
6
25
8
10
24

DIRECT FEED/EFFLUENT HEAT EXCHANGE IN FLUID CATALYTIC CRACKING

FIELD OF THE INVENTION

The invention relates to processes for fluid catalytic cracking (FCC) used to upgrade hydrocarbon feed streams and particularly those such as hydroprocessed hydrocarbons having a low coking tendency (i.e., low levels of one or more coke precursors). Representative FCC processes use direct FCC reactor feed/reactor effluent heat exchange in an FCC main column used to fractionate the effluent, combined with an oxygen-rich catalyst regeneration gas stream (e.g., having at least 90% by volume of oxygen).

DESCRIPTION OF RELATED ART

There are a number of continuous, cyclical oil refining processes in which a fluidized solid catalyst is contacted with an at least partially liquid phase hydrocarbon stream. In the fluidized contacting or reaction zone, carbonaceous and other fouling materials are deposited on the solid catalyst as coke, which reduces catalyst activity. The catalyst is therefore normally conveyed continuously to another section, namely a rejuvenation or regeneration zone, where the coke is removed by combustion with an oxygen-containing regeneration gas. The resulting regenerated catalyst is, in turn, continuously withdrawn and reintroduced in whole or in part to the contacting zone.

Possibly the most important process of this nature involves fluid catalytic cracking (FCC) of relatively high boiling or heavy hydrocarbon fractions, such as crude oil atmospheric and vacuum column residues, to lighter hydrocarbons and particularly those in the gasoline boiling range. The high boiling fraction is contacted in one or more reaction zones with the particulate cracking catalyst, which is maintained in a fluidized state, under conditions suitable for carrying out the desired cracking reactions. The absence of hydrogen in FCC provides a cracked product slate with a significant quantity of aromatic and other unsaturated compounds that are favorably blended into gasoline due to their high octane values. These gasoline boiling range hydrocarbons are normally removed as a vapor fraction from an FCC main column that fractionates the FCC reactor effluent after exiting the reaction zone. FCC is well known and described, for example, in U.S. Pat. No. 4,003,822 and other publications.

The upgrading of increasingly heavier or higher boiling feeds using FCC and other processes has become an important objective in the refining industry. Unfortunately, however, problems arise due to the tendency of such feeds to elevate coke production as a result of their higher levels of coke precursors such as Conradson carbon residue, in addition to asphaltenes and other heteroatomic compounds. The increased coke yields are normally associated with more severe reaction zone requirements (due to decreased catalyst activity) and poorer quality products. One method for beneficially reducing the level of coke precursors in high boiling hydrocarbon feeds is through hydroprocessing, which involves contacting such feeds with hydrogen in the presence of a suitable hydroprocessing catalyst. Common hydroprocessing methods include both hydrotreating (e.g., hydrodesulfurization) and hydrocracking. An example of a known hydrocracking process is described, for example, in U.S. Pat. No. 4,943,366 for converting highly aromatic, substantially dealkylated feedstock into high octane gasoline.

There is an ongoing need for improved hydrocarbon upgrading processes and particularly those in which feedstocks to FCC contain higher quality, hydroprocessed hydrocarbons that have reduced levels of coke precursors and consequently exhibit a reduced coke production in FCC.

SUMMARY OF THE INVENTION

Aspects of the invention are associated with the discovery of methods for exploiting, in fluid catalytic cracking (FCC) processes, the characteristics of hydroprocessed hydrocarbon feeds or other hydrocarbon feed streams having reduced amounts of coke precursors. In particular, such feeds having a low coking tendency can be processed using FCC with direct reactor feed/reactor effluent heat exchange to improve the yield of desired products such as gasoline boiling range hydrocarbons, while also reducing coke yield and utility requirements. Moreover, hydrocarbon feed streams including hydroprocessed hydrocarbons can be sufficiently upgraded in an FCC reaction zone such that amounts of heavy cycle oil and other conventional FCC reaction products containing hydrocarbons boiling above about 343° C. (650° F.) are significantly reduced or even eliminated.

Direct FCC reactor feed/reactor effluent heat exchange optimizes thermal efficiency and may be conveniently carried out in the main fractionating column (i.e., main column), which is downstream of the FCC reaction zone and used to fractionate and recover reaction products (e.g., fuel gas, $C_3/C_4$ hydrocarbons, gasoline boiling range hydrocarbons, and light cycle oil). Such direct heat exchange can advantageously satisfy much of the heat input required for the FCC hydrocarbon feed stream to attain the desired reaction temperature in the FCC reaction zone and consequently reduce the quantity of heat required from coke combustion in the FCC catalyst regeneration zone. Direct heat exchange similarly satisfies much of the heat removal requirement for cooling superheated FCC reactor effluent vapors in a "desuperheating" section of the FCC main column.

Despite these advantages of direct heat exchange, conventional FCC technology cannot readily adopt this mode of operation. Direct heat exchange is problematic due to the net generation of high boiling hydrocarbon products, normally recovered in the main column bottoms, which pass to the FCC reaction zone together with the hydrocarbon feed. Therefore, in the case of FCC operation with direct reactor feed/reactor effluent heat exchange in the main column, the net production or addition of such high boiling hydrocarbons, and particularly unsaturated (e.g., polyaromatic) heteroatomic hydrocarbons such as asphaltenes, would provide an FCC reaction zone inlet stream (as the main column bottoms stream) having a significant coking tendency. The processing of such a feed stream would involve the same, significant drawbacks of FCC processes attempting to operate with recycle of the main column bottoms material, namely high catalyst coke production, high regeneration temperatures, and reduced product yields.

However, with higher quality feeds such as hydroprocessed (e.g., hydrocracked or hydrotreated) hydrocarbon streams, FCC processes can be operated, according to embodiments of the invention, with little or no net production of liquid bottoms exiting the main column. Therefore, using direct FCC reactor feed/reactor effluent heat exchange in the main column, the liquid hydrocarbon feed stream flow (e.g., mass or volumetric flow rate) entering this column will substantially match the FCC main column bottoms stream flow exiting this column. Some, although often minimal, differences in the compositions between these main column liquid inlet and liquid outlet streams can result from vaporization, in the main column, of lower boiling hydrocarbons in the FCC liquid hydrocarbon feed and/or generation of minor amounts of higher boiling hydrocarbons in the FCC reaction zone that pass into the main column liquid bottoms stream and then back to the FCC reaction zone.

An additional advantage associated with the fluid catalytic cracking of hydroprocessed hydrocarbon streams or other hydrocarbon feed streams having a low coking tendency (i.e., a reduced level of one or more coke precursors), utilizing direct reactor feed/reactor effluent heat exchange as discussed above, is improved efficiency FCC catalyst regeneration, through the use of oxygen-enriched regeneration gas. In particular, the reduced amounts of catalyst coke obtained with such hydrocarbon feeds can be combusted in an environment having a higher oxygen content, relative to air or other gases fed conventionally to FCC catalyst regenerators. The higher oxygen content beneficially increases the combustion temperature of the solid, regenerated catalyst and consequently the amount of heat transferred back into the FCC reaction zone. The regeneration of conventional, spent FCC catalyst, having a relatively greater quantity of deposited coke, normally requires air or another oxygen-containing gas with a significant quantity of inert gases (e.g., nitrogen) to prevent excessive combustion temperatures and possibly damage to the catalyst and/or regenerator equipment. In contrast, according to various embodiments of the invention, representative catalyst regeneration gas streams introduced into the FCC regeneration zone have an oxygen content of at least 90% by volume, thereby diminishing the amount of nitrogen and/or other inert gases present, which act as a heat sink. Reduced catalyst coke generation, coupled with increased regeneration gas oxygen concentration, allows the FCC operation with higher quality (e.g., hydroprocessed) hydrocarbon feed streams to be improved in terms of its low overall coke yield and increased liquid product yields.

These and other aspects and embodiments associated with the present invention are apparent from the following Detailed Description.

BRIEF DESCRIPTION OF THE DRAWINGS

FIG. 1 depicts a representative fluid catalytic cracking (FCC) process utilizing direct reactor feed/reactor effluent heat exchange.

The drawing is to be understood to present an illustration of the invention and/or principles involved. Details including pumps, compressors, instrumentation, and other items not essential to the understanding of the invention are not shown. As is readily apparent to one of skill in the art having knowledge of the present disclosure, fluid catalytic cracking (FCC) processes, and particularly those involving the direct heat exchange between or among two or more process streams, according to various other embodiments of the invention, will have configurations and components determined, in part, by their specific use.

DETAILED DESCRIPTION

The present invention is associated with the discovery of fluid catalytic cracking (FCC) processes in which direct heat exchange between a hydrocarbon feed stream and an FCC effluent stream (exiting the FCC reaction zone) provides a number of advantages as discussed above, particularly if the hydrocarbon feed stream has a low coking tendency or limited content of one or more coke precursors. These advantages include more efficient overall heat management in the reaction and catalyst regeneration zones that leads to reduced utility requirements, in addition to improved yields of desired products (e.g., gasoline boiling range hydrocarbons). Particular hydrocarbon feed streams of interest, which may be favorably subjected to FCC in the processes described herein, are hydroprocessed hydrocarbon streams. These are hydrocarbons streams that have, in a prior processing step, been contacted with hydrogen in the presence of a catalyst.

Suitable hydroprocessed hydrocarbons include streams obtained from hydrotreating, hydrocracking, or combinations of these processes. Representative hydrotreating processes, for example, include those in which heavy hydrocarbon feedstocks are contacted with a suitable catalyst having hydrogenation activity under sufficient hydrogen partial pressure to reduce quantities of contaminants such as sulfur, nitrogen, metals (e.g., nickel, iron, and vanadium), Conradson carbon residue, and/or asphaltenes. Sulfur and nitrogen are typically present in such feeds in the form of, respectively, organic sulfur compounds (e.g., alkylbenzothiophenes) and organic nitrogen compounds (e.g., non-basic aromatic compounds including carbazoles). Asphaltenes refer to polycondensed aromatic compounds containing oxygen, nitrogen, and sulfur heteroatoms that are detrimental in terms of contributing to coke formation and/or process equipment fouling.

Hydrocracking processes similarly use a significant hydrogen partial pressure and a solid catalyst (either as a fixed bed or as a slurry) to improve the quality of heavy hydrocarbon feedstocks. Products of hydrocracking, however, are upgraded (e.g., more valuable) hydrocarbons with a reduced molecular weight, such as gasoline boiling range hydrocarbons, as well as distillate hydrocarbons (e.g., diesel fuel boiling range hydrocarbons) having a boiling point range which is above that of naphtha. In some cases, hydrocracking is carried out on a hydrotreated hydrocarbon stream, for example, to prolong the useful life of the downstream hydrocracking catalyst by removing one or more of the contaminants (e.g., sulfur and nitrogen), via upstream hydrotreating, as described above that can act as hydrocracking catalyst poisons.

Reaction conditions for hydrocracking are generally more severe than those in hydrotreating, although the conditions for either process can vary widely depending on the hydrocarbon feedstock quality, catalyst, and desired products. Typical conditions for hydroprocessing in general include, in a hydrotreating or hydrocracking reaction zone, an average hydroprocessing catalyst bed temperature from about 260° C. (500° F.) to about 538° C. (1000° F.), often from about 316° C. (600° F.) to about 426° C. (800° F.), and a hydrogen partial pressure from about 3.5 MPa (500 psig), often from about 6.2 MPa (800 psig) to about 21 MPa (3000 psig). The Liquid Hourly Space Velocity (LHSV, expressed in units of $hr^{-1}$), or the volumetric liquid flow rate over the catalyst bed divided by the bed volume (representing the equivalent number of catalyst bed volumes of liquid processed per hour), is typically from about 0.1 $hr^{-1}$ to about 10 $hr^{-1}$, often from about 0.5 $hr^{-1}$ to about 3 $hr^{-1}$. The inverse of the LHSV is closely related to the reactor residence time.

Particular hydroprocessed hydrocarbon streams of interest as feedstocks in the FCC processes described herein therefore include hydrotreated and hydrocracked streams. Since hydrotreating processes do not appreciably decrease hydrocarbon molecular weight, a hydrotreated hydrocarbon stream may be the entire hydrotreated reactor (or reaction zone) effluent obtained from hydrotreating a heavy hydrocarbon feedstock. In the case of a heavy hydrocarbon feedstock subjected to hydrocracking, however, a suitable hydrocracked hydrocarbon stream, as a hydroprocessed feed to FCC, may be only a high boiling fraction of the total hydrocracking reactor (or reaction zone) effluent, for example a high boiling fraction containing unconverted or only slightly reduced molecular weight hydrocarbons exiting the hydrocracking reaction zone. A high boiling fraction is normally recovered as distillation column bottoms stream or other stream containing relatively high molecular weight hydrocarbons. In the case of hydrocracking, therefore, the desired, lower boiling products (e.g., naphtha and diesel fuel) are generally separated from such a high boiling fraction of the reactor effluent, as one or more upgraded hydrocarbon products that are not used as feeds to FCC.

Heavy hydrocarbon feedstocks, which may be subjected to hydroprocessing to provide the hydroprocessed hydrocarbon stream as a feed to FCC, include gas oils such as atmospheric column gas oil and vacuum column gas oil obtained from crude oil fractionation. Other suitable heavy hydrocarbon feed stocks, or components of these feedstocks, include residual oils such as crude oil atmospheric distillation column residues boiling above about 343° C. (650° F.), crude oil vacuum distillation column residues boiling above 566° C. (1050° F.), tars, bitumen, coal oils, and shale oils. Whole or topped petroleum crude oils such as heavy crude oils may also be used as heavy hydrocarbon feedstocks, as well as other straight run and processed hydrocarbon streams that can benefit, as discussed above, from the reduction of one or more contaminants (e.g., sulfur and nitrogen compounds, metals, Conradson carbon residue, and/or asphaltenes) through contact with hydrogen under suitable hydroprocessing (e.g., hydrotreating or hydrocracking) reaction zone conditions. Combinations of the above streams may also be used. Heavy hydrocarbon feedstocks will generally contain a substantial amount, for example greater than about 80% by volume, of hydrocarbons boiling at greater than a representative cutoff temperature for a crude oil atmospheric column residue, for example 343° C. (650° F.).

The hydroprocessed hydrocarbon stream (e.g., a hydrotreating reactor effluent or a high boiling fraction of a hydrocracker reactor effluent) used a feedstock to FCC processes described herein will also generally contain at least about 60%, typically at least about 90%, and often at least about 95%, of hydrocarbons boiling at a temperature of greater than 343° C. (650° F.), thereby providing a relatively high boiling hydrocarbon feedstock that can benefit from FCC to produce lower boiling products, particularly gasoline boiling range hydrocarbons. Beneficially, since the hydroprocessed hydrocarbon has reduced amounts of coke precursors, including the contaminants discussed above, it provides a number of advantages in FCC processes of the present invention, involving direct heat exchange with the FCC reactor effluent stream, for example in the FCC main column.

Alternatively, other hydrocarbon feed streams having low levels of coke precursors, and not only those that are hydroprocessed as discussed above, may be used with advantage in FCC processes described herein. Suitable hydrocarbon feed streams, whether or not they are hydroprocessed, will generally have (i) a sulfur content of less than about 500, typically less than about 300, and often less than about 100 parts per million (ppm) by weight, (ii) a total metals content of less than about 5, typically less than about 1, and often less than about 0.5 ppm by weight, and/or (iii) a Conradson carbon residue of less than about 3%, typically less than about 1%, and often less than about 0.5% by weight. The API gravity of a hydrocarbon feed stream may range from about 10° to about 50°.

Hydroprocessed hydrocarbon streams or other hydrocarbon feed streams, for example having any one or more of the properties described above, may be passed to an FCC main column to carry out direct heat exchange with the FCC effluent stream according to embodiments of the invention described herein. For example, a representative embodiment of the invention using a hydroprocessed hydrocarbon stream as an FCC feed stream is depicted in FIG. 1. As shown in FIG. 1, hydroprocessed hydrocarbon stream 2 (e.g., a high boiling fraction obtained from a hydrocracking process distillation column bottoms) is passed to FCC main column 100. In main column 100, direct heat exchange beneficially removes heat from FCC effluent stream 4 to aid fractionation in main column 100 and also beneficially adds heat to the significant portion of the hydroprocessed hydrocarbon 2 exiting as FCC main column bottoms stream 6.

By virtue of its having been hydroprocessed, hydrocarbon stream 2 contains relatively low amounts of coke precursors (e.g., Conradson carbon residue), such that increased severity conditions in FCC reaction zone 200 can be maintained without significant catalyst coking. Therefore, the use of a hydroprocessed hydrocarbon or other low coking tendency hydrocarbon stream as a feedstock allows operation of FCC reaction zone 200 with complete or substantially complete conversion (i.e., through cracking reactions) to desired FCC products, and particularly gasoline boiling range hydrocarbons. With respect to yield maximization, all or substantially all of FCC effluent stream 4 comprises hydrocarbons boiling below 343° C. (650° F.) or otherwise below another suitable bottoms cutoff temperature of FCC main column 100. Little, if any, of FCC effluent stream 4 will therefore exit FCC main column 100 in bottoms liquid stream 6. In a representative embodiment, for example, the liquid mass flow entering FCC main column 100 as FCC effluent stream 4, minus the liquid mass flow exiting FCC main column 100 as FCC main column bottoms stream 6 will typically be less than about 5% of the liquid mass flow entering FCC main column (i.e., the FCC main column operates with a net liquid bottoms production of less than about 5% by weight). Often, the net liquid bottoms production is zero or substantially zero (e.g., less than about 1% by weight).

Although hydroprocessed hydrocarbon stream 2 has a low coking tendency, this stream contains predominantly high boiling hydrocarbons that exit FCC main column 100 in FCC main column bottoms stream 6. Due to the direct heat exchange occurring in FCC main column 100, FCC main column bottoms stream 6 exits with a significantly increased temperature, prior to contact with regenerated FCC catalyst 8, and thereby provides a substantial portion of the heat required to initiate the desired cracking reactions in FCC reaction zone 200. A representative temperature of FCC main column bottoms stream 6 is 343° C. (650° F.), but this stream may advantageously be at least about 288° C. (550° F.), and often at least about 316° C. (600° F.), with a representative range being from about 288° C. (550° F.) to about 370° C. (698° F.).

After having been heated by direct heat exchange, FCC main column bottoms stream 6 contacts regenerated FCC catalyst 8 such that this catalyst is fluidized, with the fluidized reaction mixture 10 normally flowing upwardly through FCC reaction zone 200. Using a hydroprocessed hydrocarbon stream or other feed stream having a low coking tendency as described above, a typical weight ratio of regenerated FCC catalyst 8 to FCC main column bottoms stream 6 in FCC reaction zone 200 is from about 2 to about 8, and is often from about 3 to about 6. A typical FCC reaction zone 200 is a riser reactor, in which catalyst and hydrocarbons are contacted in the proper ratio and under proper conditions of temperature, pressure, and residence time to achieve a desired conversion level for a given feed. In general, therefore, high boiling hydrocarbons in FCC main column bottoms stream 6 are converted in FCC reaction zone 200 to lower boiling hydrocarbons. Representative conditions in FCC reaction zone 200 include a temperature from about 450° C. (842° F.) to about 700° C. (1292° F.), often from about 482° C. (900° F.) to about 538° C. (1000° F.), and a pressure from about 0.07 barg (1 psig) to about 3.4 barg (50 psig), often from about 0.7 barg (10 psig) to about 2.1 barg (30 psig).

According to other embodiments of the invention, one or more conventional FCC feed streams (not shown) may be contacted with regenerated FCC catalyst 8 and converted in the fluidized reaction mixture 10, together with FCC main column bottoms stream 6. A conventional FCC feed stream may therefore be added to FCC main column bottoms stream 6 or added directly to the riser reactor upstream or downstream of the contact between FCC main column bottoms stream and regenerated FCC catalyst. Conventional hydrocarbon streams processed using FCC include high boiling fractions of crude oil, such as atmospheric and vacuum column gas oils and residues, as well as other refractory hydrocarbon streams containing predominantly hydrocarbons boiling in the range from about 343° C. (650° F.) to about 593° C. (1100° F.). In lieu of a conventional FCC feed stream, an additional feed stream having a low coking tendency (e.g., having a Conradson carbon residue of less than about 1% by weight), such as a portion of the hydroprocessed hydrocarbon stream 2 that undergoes direct heat exchange, may bypass FCC main column 100 but still be contacted with regenerated FCC catalyst 8. Operating schemes in which a portion of the hydrocarbon feed stream bypasses the FCC main column will be dictated by the overall heat balance of the process.

Suitable catalysts that are effective in carrying out the conversion to desired products, typically gasoline boiling range hydrocarbons, are zeolite-containing catalysts. These are normally preferred over amorphous catalysts because of their favorable intrinsic activity and resistance to the deactivating effects of steam (often introduced in the riser reactor as a fluidization medium and/or used to strip hydrocarbons from spent or deactivated catalyst prior to regeneration) as well as the feedstock contaminants discussed previously, and particularly metals. The zeolite component of the FCC catalyst is usually dispersed in a porous inorganic carrier material such as silica, alumna, or zirconia, with a typical catalyst composition having a zeolite content of 20% by weight or more (e.g., from about 25% to about 80%). The zeolite may be stabilized with one or more rare earth elements, for example, in a representative amount from about 0.1% to about 10% by weight.

Although conversion to gasoline boiling range hydrocarbons is often desirable, the severity of conditions in FCC reaction zone 200 can be varied to target other products. For example, decreased and increased operating severity can provide, respectively, greater amounts of distillate boiling range hydrocarbons, or greater amounts of $C_4^-$ hydrocarbons, and particularly valuable olefinic hydrocarbons such as propylene. Regardless of the operating severity, the product hydrocarbons in FCC effluent stream 4, having a reduced boiling point, are separated using FCC main column 100, optionally in combination with additional distillation columns and/or flash separators providing one or multiple stages of vapor-liquid contacting to separate products on the basis of differences in relative volatility. In a representative process in which gasoline boiling range hydrocarbons are desired, the yield of these hydrocarbons in the FCC effluent stream 4, and recovered in FCC main column 100, is at least about 50% by weight, and often at least about 60% by weight (e.g., from about 60% to about 75% by weight) based on the weight of the feed stream, namely hydroprocessed hydrocarbon stream 2. Gasoline boiling range hydrocarbons can include, for example, $C_5^+$ hydrocarbons having a distillation temperature of 380° F. (193° C.) at the 90% recovery point.

These gasoline boiling range hydrocarbons can be separated as an FCC gasoline product stream 14, along with other products, from FCC main column bottoms stream 6. Other product streams or fractions that can be separated using FCC main column 100 include a $C_4^-$ hydrocarbon stream 12 that is typically further separated into fuel gas and more valuable $C_3/C_4$ hydrocarbons. Further product streams may include one or more products containing higher boiling hydrocarbons, compared to those in FCC gasoline product stream 14. Examples of such product streams are heavy naphtha product 16 and light cycle oil product 18. According to the embodiment illustrated in FIG. 1, therefore, FCC gasoline product stream 14 is removed from FCC main column 100, separate from $C_4^-$ hydrocarbon stream 12, such that FCC gasoline product stream 14 is substantially free of $C_4^-$ hydrocarbons (e.g., FCC gasoline product stream 14 contains less than about 3%, and often less than about 1% by volume of $C_4$ and lighter hydrocarbons). In other embodiments, gasoline boiling range hydrocarbons may be combined with other hydrocarbons, including $C_4^-$ hydrocarbons, in a distillation fraction, such as an overhead vapor fraction, exiting FCC main column 100. Further separation of this overhead vapor fraction, or treatment in a gas concentration unit, can then provide an FCC gasoline product stream substantially free of $C_4^-$ hydrocarbons.

The FCC process illustrated in the embodiment of FIG. 1 is operated with a dynamic heat balance, whereby heat is supplied to FCC reaction zone 200 not only by the hot, regenerated catalyst 8, but also by direct heat exchange of the feed in FCC main column 100 as discussed above. An integral part of the FCC process therefore involves separating and removing spent FCC catalyst 22 from FCC reaction zone 200 to remove deposited coke in FCC regenerator or regeneration zone 300. Both (i) the coke formed in the fluidized reaction mixture 10 as a byproduct of the desired catalytic cracking reactions, and (ii) metal contaminants in the hydroprocessed hydrocarbon feed 2, serve to deactivate the FCC catalyst by blocking its active sites. Coke must therefore be removed to a desired degree by regeneration in FCC regeneration zone 300, which involves contacting spent FCC catalyst 22 with oxygen-rich regeneration gas stream 24. Oxygen-rich regeneration gas 24 therefore combusts accumulated coke on FCC spent catalyst 22 to provide regenerated FCC catalyst 8, typically having a level of deposited coke of less than about 3%, and often less than about 1% by weight. As shown in FIG. 1, valves 25 can regulate the flow of both regenerated catalyst to, and spent catalyst from, FCC reaction zone 200.

Because hydroprocessed hydrocarbon stream 2 or other feed streams used in the direct heat exchange processes described herein have reduced coke precursors, levels of catalyst coke deposited on spent FCC catalyst 22 are generally significantly lower than those obtained in conventional processes. This beneficially allows for the use of a regeneration gas stream having a relatively high content of oxygen that increases the combustion temperature in FCC regeneration zone 300 and reduces the heat lost through the removal of heated, inert gases such as nitrogen, in regeneration flue gas stream 26. Heat is therefore more efficiently transferred to FCC reaction zone 200 through the return of hot, regenerated FCC catalyst 8. In representative embodiments, the regeneration gas comprises oxygen in an amount above that contained in air, such that oxygen-enriched air is often suitable as a regeneration gas. Oxygen-rich regeneration gas stream 24 generally comprises oxygen in an amount of greater than about 50%, typically greater than about 85%, and often greater than about 90% by volume. Pure oxygen may also be used. The resulting combustion or regeneration zone temperature, corresponding to these levels of oxygen, is generally in the range from about 538° C. (1000° F.) to about 816° C. (1500° F.), often in the range from about 649° C. (1200° F.) to about 760° C. (1400° F.). Flue gas stream 26 contains mostly the products of coke combustion, namely CO, $CO_2$, and water vapor (steam), and possibly additional steam introduced into regeneration zone 300 to strip residual hydrocarbons from the spent catalyst.

As discussed above, additional embodiments of the invention involve the integration of FCC processes, such as those according to the embodiment illustrated in FIG. 1, with upstream hydroprocessing to provide the hydroprocessed hydrocarbon feed. In the case of hydrocracking, for example, a heavy hydrocarbon feedstock (e.g., a gas oil or residue obtained from fractionation of crude oil under atmospheric or vacuum pressure or other refractory crude oil straight-run or processed fraction) is hydrocracked as discussed above to provide a hydrocracking reaction zone effluent. One or more upgraded hydrocarbon products (e.g., naphtha and/or diesel fuel) are obtained from fractionating the hydrocracking reaction zone effluent, as well as a high boiling fraction such as the bottoms product from a distillation column in a hydrocracking product recovery section. This high boiling fraction from hydrocracking is then used as a hydroprocessed hydrocarbon feedstock as described above, which is passed to the FCC main column for direct heat exchange with the FCC effluent stream.

Further embodiments of the invention are more generally directed to FCC methods comprising contacting hydrocarbon feeds having a low coking tendency (e.g., having a Conradson carbon residue of less than about 1% by weight) with a regenerated FCC catalyst in an FCC reaction zone and regenerating the spent FCC catalyst separated from this reaction zone with an oxygen-enriched regeneration gas as discussed above. Hydrocarbon feeds with a low coking tendency have low levels, in amounts as described above, of any, some, or all of the contaminants identified above as coke precursors, including sulfur, metals, and Conradson carbon.

Overall, aspects and embodiments of the invention are directed to FCC processes in which direct heat exchange occurs between a hydrocarbon feed stream such as a hydroprocessed hydrocarbon stream, or a portion thereof, and an FCC effluent stream, or portion thereof. Those having skill in the art, with the knowledge gained from the present disclosure, will recognize that various changes can be made in the above processes, as well as the corresponding flowschemes and apparatuses, without departing from the scope of the present disclosure. Mechanisms used to explain theoretical or observed phenomena or results, shall be interpreted as illustrative only and not limiting in any way the scope of the appended claims.

The following example is set forth as representative of the present invention. This example is not to be construed as limiting the scope of the invention as other equivalent embodiments will be apparent in view of the present disclosure and appended claims.

Example 1

Computer modeling was used to predict product yields obtained from fluid catalytic cracking (FCC) using, as a hydrocarbon feed stream, a hydroprocessed hydrocarbon stream. This stream was namely a representative high boiling hydrocarbon fraction obtained from a commercial hydrocracker, at a 10,000 barrels per stream day (BPSD) flow rate. In particular, the model simulated the direct heat exchange between this hydrocarbon feed stream and the FCC effluent in the FCC main column. The simulated main column bottoms stream was a hydrocarbon fraction comprising >95% by volume of hydrocarbons boiling at a temperature of greater than 343° C. (650° F.). According to the yield estimating model, conversion of this stream in the FCC reaction zone provided a greater than 65% by weight yield of a gasoline boiling range hydrocarbon fraction, characterized as $C_5^+$ hydrocarbons having a distillation temperature of 193° C. (380° F.) at the 90% recovery point. The simulated regeneration gas stream for combusting coke on spent FCC catalyst contained >90% by volume of oxygen and provided a regeneration temperature of 719° C. (1326° F.).

A summary of the simulated operating conditions and product yields, together with some comparative conditions and results obtained for a conventional FCC process, are shown in Table 1. More detailed operating conditions, as well as feed and product properties, are provided in Table 2.

TABLE 1

Summary of Conditions and Yields Versus Conventional FCC Operation

| 10,000 BPSD Comparison | Directed Feed/Effluent Heat Exchange | Conventional |
|---|---|---|
| Reactor Temperature | 990° F. | 990° F. |
| Feed Temperature | >650° F. | 450° F. |
| Catalyst Activity | 74 | 74 |
| Cat/Oil, weight ratio | 5.18 | 8.5 |
| Regeneration Temperature | 1326° F. | 1225° F. |
| Reactor Pressure | 20 psig | 20 psig |
| Oxygen in Air to Regenerator | 95% | 21% |
| Combined Feed Ratio | 1.03 (volumetric) | 1.0 |
| Yields, wt-% | | |
| $C_2$ | 2.93 | |
| $C_3/C_4$ | 7.6/13.4 | |
| Gasoline | 68.1 | |
| LCO | 4.82 | |
| CO | 0.11 | 1.5 |
| Coke | 3.01 | 4.5 |
| Flue Gas, mol-% | | |
| $CO_2$ | 86.6 | 16.9 |
| $O_2$ | 1.0 | 1.0 |
| $N_2$ | 12.3 | 81.9 |
| Wet, H2O | 32.2 | 8.3 |

TABLE 2

Detailed Operating Conditions and Yields

| | |
|---|---|
| Charge Rate, BPSD: | 10000 |
| Charge Stock Properties: | |
| API Gravity | 39.18 |
| UOP K | 12.97 |
| Molecular Weight | 452.3 |
| Nickel, ppm | 0.1 |
| Vanadium, ppm | 0.1 |
| Sulfur, ppm | 15 |
| Conradson Carbon, wt-% | 0.10 |
| 650 F Minus, vol-% | 4.7 |
| Molecular Weight | 452.3 |

Notes For This Case:
1. Regeneration gas is about 93% Enrichment $O_2$ stream.
2. Feed is used to wash to main column lower section and desuperheats the reactor vapors.
3. Heated Feed Oil from the bottom of the main column is Pumped to the riser feed nozzles, carrying with it about 0.03 V/V of slurry recycle.

TABLE 2-continued

4. The wet flue gas under these conditions will contain approximately 32 mol-% Steam.

| | |
|---|---|
| Catalyst: | |
| Activity | 74 |
| Operating Conditions: | |
| Catalyst/Oil Ratio | 5.18 |
| Combined Feed Ratio | 1.03 |
| Composition of Recycle | |
| Heavy Cycle Oil | 0.00 |
| Slurry Settler Bottoms | 0.03 |
| Steam to Riser, wt-% Feed | 3.00 |
| Raw Oil Temperature | 650° F. |
| Reactor Temperature, DEG F | 990° F. |
| Reactor Pressure, PSIG | 20 psig |
| Regenerator Temperature | 1326° F. |
| $O_2$ Enrichment, mol-% | 90 |
| $O_2$ Rate at 95% Purity, SCFM | 2245 |
| Dry Enriched Air, LB/LB Coke | 3.42 |
| Hydrogen in Coke, wt-% | 8.00 |
| Sulfur in Coke, wt-% | 0.01 |
| Conversion, vol-% (as produced) | 95.20 |
| Conversion, vol-% (90% @ 380 F) | 95.20 |

| Estimated Product Yields: | WT % | API | LV % |
|---|---|---|---|
| $H_2S$ | | | |
| $C_2$− | 2.93 | | |
| $C_3$ | 7.57 | 141.95 | 12.13 |
| $C_4$ | 13.44 | 111.29 | 19.12 |
| Gasoline (90% @ 380) | 68.12 | 66.00 | 78.82 |
| LCO (90% @ 600) | 4.82 | 35.00 | 4.70 |
| Clarified Oil | 0.11 | 20.00 | 0.10 |
| Coke | 3.01 | | |
| TOTAL | 100.00 | | 114.87 |

| | |
|---|---|
| $C_2$ minus, mol-% | |
| $H_2$ | 16.40 |
| $C_1$ | 44.00 |
| $C_2$= | 18.90 |
| $C_2$ | 20.70 |
| $C_3$, liquid vol-% | |
| $C_3$= | 68.00 |
| $C_3$ | 32.00 |
| $C_4$, liquid vol-% | |
| $C_4$= | 45.00 |
| I-$C_4$ | 41.00 |
| N-$C_4$ | 14.00 |
| $C_5$ vol-% | |
| $C_5$= | 37.00 |
| I-$C_5$ | 52.00 |
| N-$C_5$ | 11.00 |
| vol-% $C_5$ in $C_5$+ Gasoline | 22.59 |

According to these simulated results, the hydroprocessed hydrocarbon feed stream can undergo, in the FCC main column, direct heat exchange with the FCC reactor effluent stream under process conditions whereby the net liquid bottoms production in this column is substantially zero. The model demonstrates a high yield of gasoline boiling range hydrocarbons, little coke generation, and efficient catalyst regeneration zone operation with a regeneration gas stream having greater than about 90% by volume of oxygen.

The invention claimed is:

1. A fluid catalytic cracking (FCC) method comprising:

(a) passing a hydroprocessed hydrocarbon stream to an FCC main column;

(b) directly exchanging heat, in said FCC main column, between said hydroprocessed hydrocarbon stream and an FCC effluent stream to provide an FCC main column bottoms stream; and (c) contacting said FCC main column bottoms stream with a regenerated FCC catalyst in an FCC reaction zone to provide said FCC effluent stream.

2. The process of claim 1, wherein said hydroprocessed hydrocarbon stream is a reactor effluent, or a high boiling fraction thereof, obtained from hydrocracking, hydrotreating, or a combination thereof.

3. The process of claim 2, wherein said hydroprocessed hydrocarbon stream and said FCC main column bottoms stream comprise greater than about 90% by weight of hydrocarbons boiling at a temperature of greater than 343° C. (650° F.).

4. The process of claim 1, wherein said FCC main column bottoms stream has a temperature of at least about 288° C. (550° F.) prior to contact with said regenerated FCC catalyst in step (c).

5. The process of claim 1, wherein said hydroprocessed hydrocarbon stream has a total metals content of less than about 5 ppm, a sulfur content of less than about 500 ppm, and a Conradson carbon residue of less than about 1% by weight.

6. The process of claim 1, wherein said FCC main column operates with a net liquid bottoms production of less than about 5% by weight.

7. The process of claim 6, wherein said net liquid bottoms production is substantially zero.

8. The process of claim 1, further comprising removing a spent FCC catalyst exiting said FCC reaction zone and regenerating said spent FCC catalyst in the presence of an oxygen-rich regeneration gas stream.

9. The process of claim 8, wherein said regeneration gas comprises oxygen in an amount of greater than about 50% by volume.

10. The process of claim 1, wherein said regenerated catalyst comprises less than about 1% by weight of deposited coke.

11. The process of claim 1, further comprising removing an FCC gasoline product stream from said FCC main column, wherein said FCC gasoline product stream, optionally after further separation, is substantially free of $C_4^-$ hydrocarbons.

12. The process of claim 1, wherein a yield, in said FCC effluent, of $C_5^+$ hydrocarbons having a distillation temperature of 193° C. (380° F.) at the 90% recovery point is at least about 60% by weight.

13. The process of claim 1, wherein said FCC reaction zone has a temperature from about 450° C. (842° F.) to about 700° C. (1292° F.) and a pressure from about 0.07 barg (1 psig) to about 3.4 barg (50 psig).

14. The process of claim 1, wherein, in step (c), a combination of said FCC main column bottoms stream and an additional hydrocarbon stream are contacted with said regenerated FCC catalyst in said FCC reaction zone to provide said FCC effluent stream.

15. An integrated process for producing a fluid catalytic cracking (FCC) gasoline product, the process comprising:

(a) hydrocracking a heavy hydrocarbon feedstock in a hydrocracking reaction zone in the presence of hydrogen to provide a hydrocracking reaction zone effluent;

(b) fractionating said hydrocracking zone effluent to provide one or more upgraded hydrocarbon products and a high boiling fraction;

(c) directly exchanging heat between said high boiling fraction and an FCC effluent stream in an FCC main column to provide an FCC main column bottoms stream;

(d) separating said FCC gasoline product, in one or more fractions, from said FCC effluent in said FCC main column; and (e) contacting said FCC main column bottoms stream with a regenerated catalyst in an FCC reaction zone to provide said FCC effluent stream.

16. The integrated process of claim 15, wherein said heavy hydrocarbon feedstock comprises greater than about 80% by weight of hydrocarbons boiling at a temperature of greater than 343° C. (650° F.).

17. The integrated process of claim 16, wherein said heavy hydrocarbon feedstock comprises a crude oil atmospheric column residue or a crude oil vacuum column residue.

18. The integrated process of claim 15, wherein, in step (d), said gasoline product is separated in said FCC main column in a single fraction that is substantially free of $C_4^-$ hydrocarbons, optionally after further separation.

19. A fluid catalytic cracking (FCC) method comprising:

(a) contacting a hydrocarbon feed stream having a Conradson carbon residue of less than about 1% by weight with a regenerated FCC catalyst in an FCC reaction zone; and (b) regenerating a spent FCC catalyst from said FCC reaction zone with a regeneration gas stream comprising oxygen in an amount of greater than about 50% by volume.

20. The method of claim 19, wherein said hydrocarbon feed stream comprises a bottoms stream of an FCC main column that fractionates an FCC effluent stream exiting said FCC reaction zone.

* * * * *